United States Patent [19]

Fukubayashi et al.

[11] Patent Number: 4,975,621

[45] Date of Patent: Dec. 4, 1990

[54] COATED ARTICLE WITH IMPROVED THERMAL EMISSIVITY

[75] Inventors: Harold H. Fukubayashi, Indianapolis; Jiinjen A. Sue, Carmel; Robert C. Tucer, Jr., Brownsburg; Ronnie J. Doan, Indianapolis, all of Ind.

[73] Assignee: Union Carbide Corporation, Danbury, Conn.

[21] Appl. No.: 371,113

[22] Filed: Jun. 26, 1989

[51] Int. Cl.[5] ..... H01J 35/08

[52] U.S. Cl. ..... 313/633; 313/311; 313/355; 313/39; 378/129

[58] Field of Search ..... 313/311, 633, 355, 39, 313/40, 41; 378/127, 129, 143, 144

[56] References Cited

U.S. PATENT DOCUMENTS

| | | | |
|---|---|---|---|
| 4,132,916 | 1/1979 | Hueschen et al. | 313/330 |
| 4,271,372 | 6/1981 | Geldner et al. | 313/330 |
| 4,327,305 | 4/1982 | Weber | 313/330 |
| 4,516,255 | 5/1985 | Petter et al. | 378/143 |
| 4,637,042 | 1/1987 | Braun | 378/143 |

*Primary Examiner*—Kenneth Wieder

*Attorney, Agent, or Firm*—E. Lieberstein

[57] ABSTRACT

A coated article suitable for use in a vacuum consisting essentially of a refractory metal substrate and a first coating of $TiB_2$ and Mo. An overcoat of $TiB_2$ may be applied to the first coating as a second layer upon which additional layers may be applied if desired.

9 Claims, 1 Drawing Sheet

COATED ARTICLE WITH IMPROVED THERMAL EMISSIVITY

FIELD OF THE INVENTION

The present invention relates to a coated article having a high resistance to spalling for use in a vacuum environment and in particular to a coated article for use as an anode in a vacuum tube.

BACKGROUND OF THE INVENTION

Coated articles which have a high resistance to spalling have general application in the aerospace industry and, in particular, are useful as a coated anode in a vacuum tube for generating X-rays. Vacuum tubes used for the generation of x-rays typically comprise a cathode which directs a stream of high-energy electrons upon a metallic anode. The interaction of electrons of the anode atoms and the high-energy electrons produces x-rays. Most of the energy from the high energy electron stream is converted to heat energy. Since the anode is essentially in a vacuum, the only significant means of dissipating heat from the anode is by radiation. Since more heat results as power of the electron beam is increased, the use of high power may cause excessive heating of the anode, particularly at the point at which the electron beam strikes the anode.

In response to the problem of over-heating of the anode at high power, a rotating anode has been developed. A rotating anode is typically in the form of a spinning wheel with a beveled edge. The electron beam is directed upon a target track on the beveled edge. As the anode rotates, the electron beam strikes a surface of the target track, thus dissipating the generation of heat over a larger surface. Typically, rotating anodes are made of a molybdenum alloy with a tungsten insert for the target track.

Rotating anodes have enabled production of x-ray tubes of significantly increased power; however, power output is still limited by the transfer of radiant heat from the anode, which is in large part determined by the thermal emissivity of the surface of the anode. In order to increase the radiant heat transfer, either one or both of the faces of rotating anodes have been coated with a high-temperature resistant coatings which increase the thermal emissivity of the coated surfaces. Typical coating materials are metal oxides, such titania, alumina, zirconia, stabilized zirconia compounds or mixtures thereof. Common coating materials include a titania/alumina mixture, or a calcia stabilized zirconia/-calcia/titania mixture.

With the development of higher-power x-ray tubes which are operated continuously for a long period of time, for example, for computer assisted tomography (CAT) scanning equipment, the heat dissipation problem from the anode has become more severe, and thus a limiting factor in the tube design. Another design problem is due to the fact that the front face of a rotary anode generally is of a higher temperature than the back face, while the tube is operating. Therefore, it is typical commercial practice to coat only the cooler back face, since prior-art coatings have generally been found to either spall off of the hotter front face or cause arcing between the track and the coated area. The mechanism of arcing is not completely understood, but it is believed to relate to the evolution of gases from the coating, such as $H_2$ and CO. Therefore, the high temperature properties of prior art coatings, e.g. spalling and gas evolution, have often prevented coating of the front face and thus limited the ultimate heat transfer rate from the anode.

A suitable coating material should have a high thermal emissivity, while being resistant to high temperatures, and resistance to thermal shock which may spall the coating from the anode surface. In addition, the coating material should have a minimum evolution of gas at the operating temperatures of the anode. Further, the coating should have a thermal conductivity sufficiently high such that the coating does not insulate the anode and significantly impede conduction of heat to the surface. More particularly, the coating should meet the following requirements; (1) the coating should have a coefficient of expansion similar to the substrate material, (2) there should be little or no diffusion reaction between the coating and the substrate, (3) the coating should have a very low vapor pressure at temperatures above 1100° C., preferably about 1300° C., and (4) the cost of the coating material should be reasonable.

Although prior art coated anodes have been successful at moderate operating temperatures in increasing the radiant heat transfer from anodes, there is a continuing need due to increasing power requirements in the art for an anode with high thermal emissivity at higher operating temperatures and for highly emissive coatings which do not spall or cause arcing at these higher operating temperatures during use of the anode.

OBJECTS OF THE INVENTION

An object of the present invention is to provide a coated article with a high thermal emissivity suitable for continuous operation in a vacuum at high operating power.

Another object of the invention is to provide a coated article for use as an anode capable of continuous exposure at high temperatures with resistance to spalling, and without any significant evolution of gasses.

A further object of the invention is to provide a coated article having a thermal emissivity of above 0.6 in an operating temperature range of 700–1500° C.

SUMMARY OF THE INVENTION

An embodiment of the invention is a vacuum tube anode comprising a refractory metal substrate and a coating upon at least a portion of a surface of the substrate, the coating consists essentially of about 50 to about 95 percent, preferably between about 80 to about 90 percent, titanium diboride by volume and about 5 to about 30 percent, preferably between about 10 to about 20, percent by volume of a refractory metal. The volume fraction in percent is exclusive of porosity.

The refractory metal should preferably be selected from the group consisting of molybdenum, tungsten, tantalum, niobium, and mixtures or alloys thereof. The preferred refractory metal is molybdenum, because of its compatability with molybdenum substrate materials commonly used for rotary anodes and its stability relative to $TiB_2$.

The coating may also comprise a second layer consisting essentially of titanium diboride, which should overlie and be contiguous to the first layer. When a second layer is applied, the first layer should consist essentially of 30–90 percent, preferably 50–85 percent, titanium diboride by volume remainder refractory metal. Additional layers may also be applied for forming the coated article and need not be limited to titanium diboride.

The anodes of the invention are preferably anodes adapted for use in X ray tubes, most preferably as rotating anodes. However, use of the coatings of the invention as other vacuum tube anodes, or parts of anodes, are contemplated by the invention in environments where radiant heat dissipation is an important factor. As used herein, an anode in a vacuum tube is a component that emits, captures, or modifies a stream of electrons.

The anode of the invention comprises a substrate, typically a refractory metal suitable for the intended use of the anode. For rotating anodes in X-ray tubes, the substrate is preferably a material used in the art for rotating anodes, such as tungsten, or a molybdenum alloy with a tungsten or tungsten alloy target inlay. Commonly, rotating anodes comprise a molybdenum alloy, such as those known in the art as TZM having a composition of 0.5% Ti, 0.1% Zr, 0.02% W balance Mo.

The anodes of the invention enable a higher transfer of heat from the anode during operation by increasing the emissivity of the surface. This is achieved by applying a titanium diboride/refractory metal coating, as defined above, over a portion of the surface of the anode. The coating preferably covers a major portion of a heat radiating surface on the anode.

The coatings may be applied to the substrate by any suitable thermal spray technique, including plasma spray deposition, detonation gun deposition and hypersonic combustion spray, physical vapor deposition, slurry/sinter techniques, electrolytic deposition and solgel deposition.

The thermal emissivity of the coated article should be at least 0.6 and preferably above 0.7 at operating temperatures above 1100° C.

DETAILED DESCRIPTION

Figure 1:
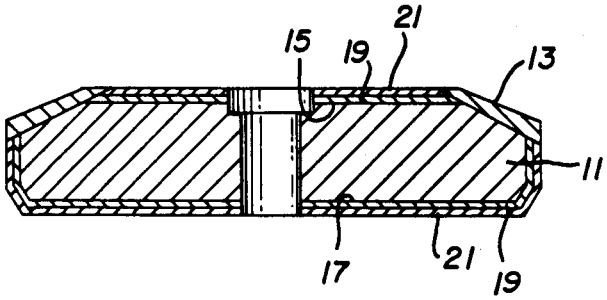
FIG. 1 is an elevation view, partially in cross-section, of an X-ray tube rotating anode.
Figure 2:
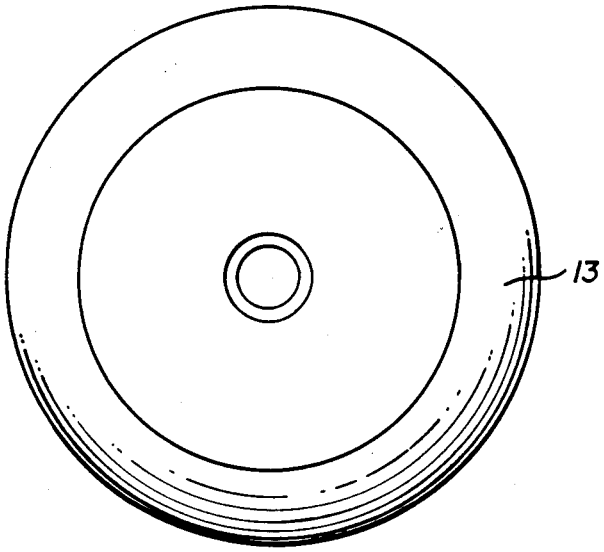
FIG. 2 is a plan view of the rotating anode of FIG. 1.

The Figure show a rotary X-ray anode comprising a substrate 11 of a molybdenum alloy, such as TZM. A layer of tungsten 13 is disposed over the substrate in the area of the focal path, which is on the front surface 15 of the rotary anode. Front and rear 15,17 surfaces of the anode surface not corresponding to the area of the focal path, are covered with an under-coating 19 of titanium diboride and a refractory metal. An over-coating 21 consisting essentially of titanium diboride overlies the under coating 19.

The ceramic or metallic carbide coatings are preferably applied to the substrate by either of two well known techniques, namely, the detonation gun (D gun) process or the plasma spray coating process. The detonation gun process is well known and fully described in U.S. Pat. Nos. 2,714,563, 4,173,685, and 4,519,840, the disclosures of which are hereby incorporated by reference. The plasma technique for coating a substrate is conventionally practiced and is described in U.S. Pat. Nos. 3,016,447, 3,914,573, 3,958,097, 4,173,685 and 4,519,840, the disclosures of which are incorporated herein by reference.

Although the coatings of the present invention are preferably applied by detonation or plasma deposition, it is possible to employ other thermal spray techniques such as, for example, high velocity combustion spray (including hypersonic combustion spray), flame spray and so called high velocity plasma spray methods (including low pressure or vacuum spray methods). Other techniques can be employed for depositing the coatings of the present invention as will readily occur to those skilled in the art.

The powder used in this invention to form the underlayer preferably consists of a mechanical mixture of two or more components The first component is pure titanium diboride, while the additional component comprises refractory metals or alloys, or mixtures thereof. Alternatively, the titanium diboride may be dispersed in a refractory metal matrix by sintering and crushing, mechanical alloying, aglomeration by spray drying of ultrafine powders, or any other means.

The powders used in the present invention may be produced by conventional techniques including casting and crushing, atomization and sol-gel.

For most thermal spray applications, the preferred powder size will be −200 mesh (Tyler) or less. For many plasma or detonation gun coatings, an even finer average powder size, preferably −325 mesh or less, may be used.

EXAMPLE 1 (comparative)

A powder of $Cr_3C_2$ with 20 weight percent Ni—Cr (80 Ni-20 Cr) alloy was applied by a D-gun apparatus to form a coating of a thickness of from 0.0010 to 0.0015 inches to the front face of a TZM X-ray tube target. The target was heated to 1175° C. under $10^{-6}$ torr pressure for 30 minutes. The coating spalled.

EXAMPLE 2 (comparative)

Pure $Cr_3C_2$ powder was applied by a D-gun apparatus to form a coating of thickness of from 0.0010 inch to 0.0015 inches to the front face of TZM targets for X ray tubes. For some tests, the coatings were applied directly over the TZM target, while others were applied over a 0.001 inch thick undercoat $Cr_3C_2$+20% Ni-Cr applied by a D-gun apparatus. Each coated target was heated to 1175° C. under $10^{-6}$ torr pressure for 30 minutes. All of the coatings spalled from the targets.

EXAMPLE 3 (comparative)

Sintered and crushed powder containing 82% $TiB_2$ and 18% Ni by volume was plasma sprayed to form a coating of a thickness of from 0.001 to 0.002 inches on a TZM target surface. The surface was heated at 1150° C. at $10^{-5}$ torr pressure for 16 hours. The coating spalled.

EXAMPLE 4 (invention)

A mechanically blended powder of 84 percent $TiB_2$ and 16 percent Mo by volume was plasma sprayed to a thickness of 0.0010 to 0.0015 inches on the front face of a TZM target. The target was heated at 1150° C. at $10^{-5}$ torr for 16 hours. There was no spalling. The same target was also subsequently heated to 1200° C. at 10 torr. There was no spalling evident in either test. The thermal emissivity was found to be near 0.7.

EXAMPLE 5 (invention)

A coated anode was produced by plasma spraying an under layer, 0.001 inch thick, of 84 percent $TiB_2$ and 16 percent Mo by volume over both the front and back faces of a TZM target. A pure $TiB_2$ over layer was then plasma sprayed to a thickness of from 0.001 to 0.0015 inches over the under-layer. The target was then heated to 1200° to 1300° C. at $10^{-6}$ torr. There was no spalling of the coating. The emissivity was found to be slightly above 0.7.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A coated article having at least a predetermined area on the surface thereof characterized by a high resistance to spalling when used in a vacuum with a high thermal emissivity consisting essentially of a refractory metal substrate and a surface coating covering at least said predetermined area with said surface coating being substantially free of oxides and having at least a first layer consisting essentially of about 50 to about 95 percent by volume of titanium diboride and about 5 to about 50 percent by volume of a refractory metal.

2. A coated article as defined in claim 1 for use as an anode in a vacuum tube.

3. A coated article as defined in claim 2 wherein said anode is a rotary anode of an X-ray tube.

4. A coated article as defined in claims 1 or 3 wherein the thermal emissivity of the layer is greater than about 0.6 at a temperature above 1100° C.

5. A coated article as defined in claim 2 wherein the thickness of the first layer is between about 0.0005 inch and about 0.003 inches.

6. A coated article as defined in claim 1 comprising a second layer covering said first layer with the second layer consisting essentially of titanium diboride.

7. A coated article as defined in claim 6 wherein said first layer consists substantially of from about 60 to about 80 volume percent titanium diboride and from about 10 to about 20 volume percent of a refractory metal.

8. A coated article as defined in claims 1 or 6 wherein the refractory metal is selected from the group consisting of molybdenum, tungsten, tantalum, hafnium, niobium, mixtures and alloys thereof.

9. A coated article as defined in claim 8 wherein the emissivity of the surface of the second layer is at least about 0.7.

* * * * *